US005513919A

United States Patent [19]

Hevenor

[11] Patent Number: 5,513,919

[45] Date of Patent: May 7, 1996

[54] METHOD AND APPARATUS FOR PRINTING ON SHEET MATERIAL

[75] Inventor: Charles M. Hevenor, Glastonbury, Conn.

[73] Assignee: Gerber Scientific Products, Inc., Manchester, Conn.

[21] Appl. No.: 54,754

[22] Filed: Apr. 27, 1993

[51] Int. Cl.[6] ..... B41J 2/32

[52] U.S. Cl. ..... 400/120.02; 400/208; 400/577

[58] Field of Search ..... 400/577, 120 MP, 400/240, 240.3, 240.4, 207, 208, 120.02

[56] References Cited

U.S. PATENT DOCUMENTS

| | | | |
|---|---|---|---|
| 4,644,370 | 2/1987 | Watanabe | 400/202 |
| 4,789,257 | 12/1988 | Brown et al. . | |
| 4,794,404 | 12/1988 | Shiraishi | 400/240.4 |
| 4,815,878 | 3/1989 | Oba | 400/577 |

FOREIGN PATENT DOCUMENTS

| | | | |
|---|---|---|---|
| 206238 | 12/1986 | European Pat. Off. | 400/120 MP |
| 57-020381 | 2/1982 | Japan . | |
| 61-024483 | 2/1986 | Japan . | |
| 63-286378 | 12/1988 | Japan . | |
| 01218868 | 9/1989 | Japan . | |
| 43257 | 2/1991 | Japan | 400/120 MP |
| 189583 | 7/1992 | Japan | 400/120 MP |

*Primary Examiner*—Christopher A. Bennett
*Assistant Examiner*—Steven S. Kelley
*Attorney, Agent, or Firm*—McCormick, Paulding & Huber

[57] ABSTRACT

A thermal printer carries out printing operations to produce images in multiple colors in response to a printing program. In order to eliminate distortions and to insure registration of colors in the printed image, a printer controller eliminates backlash in the drive mechanism at the beginning of each printing operation.

17 Claims, 5 Drawing Sheets

METHOD AND APPARATUS FOR PRINTING ON SHEET MATERIAL

BACKGROUND OF THE INVENTION

The present invention relates to a method and apparatus for printing on sheet material and is particularly useful for printing signs and other artistic designs in accordance with a printing program.

U.S. patent application Ser. No. 08/007,662, filed Jan. 22, 1993 describes, among other things, thermal printing apparatus that can be used to generate signs, designs, characters and other graphic images on a strip of sheet material in accordance with a stored printing program. The program is read and translated into machine commands by a microprocessor-based controller and causes the stored image to be generated on the strip of sheet material by the printer. The printer is preferably a thermal printer having a thermal printhead mounted in stationary relationship with respect to the strip of sheet material during a printing operation, and the strip of sheet material is fed under the printhead by a mechanical drive mechanism. The controller coordinates the operation of the printhead and the mechanical drive mechanism in order to place the printed image at a desired location on the strip of material. In one form, the strip of material is a strip of vinyl secured to a backing material by a pressure sensitive adhesive so that after printing the vinyl bearing a printed image can be cut and stripped from the backing material and thereafter placed on an appropriate sign board.

The thermal printer in the referenced application utilizes a web of thermally releasable inking material to produce images in color. Multi-colored images can be produced by the printer simply by passing the strip of sheet material through the printer relative to the printhead two or more times and substituting a web bearing an inking material of a different color on each pass. When the images are produced in separate passes and, therefore at different times, small misalignments between the images or distortions of just one image may create noticeable errors or defects that detract from or totally destroy the resulting product. Many printed products such as commercial signs or artwork require high quality printing without notable distortion or registration errors. Such errors can arise at the beginning of each printed image simply because of backlash in the drive mechanism that moves the printhead and sheet material relative to one another.

It is accordingly a general object of the present invention to provide a method and apparatus by which the distortion and error associated with backlash are eliminated from images that are prepared by a printing apparatus having a drive mechanism for moving the printhead and sheet material relative to one another during a printing operation.

SUMMARY OF THE INVENTION

The present invention resides in a method and apparatus for printing on sheet material in response to a printing program that defines images to be prepared during a printing operation. The apparatus which performs the method includes a printhead for placing printing on the sheet material, and drive means coupled with the printhead and the sheet material for moving the printhead and material relative to one another during a printing operation. Such movement spreads the printed image generated by the head over various locations on the sheet material.

Controller means connected with the printhead and the drive means responds to the printing program and coordinates the operation of the printhead and the drive means to place the print at the various locations on the sheet material. For example, in one embodiment of the invention the printhead is a thermal printhead mounted in stationary relationship within the apparatus, and a strip of the sheet material engaged by the drive means is moved relative to the head during the printing operation. The program generally has an origin point where the printing starts and all portions of the image are generally located relative to the origin point.

In accordance with the present invention, the controller means includes backlash elimination means actuating the drive means and displacing the printhead and sheet material relative to one another by an incremental amount prior to the start of a printing operation at the origin point of the program. The incremental displacement by the drive means insures the accurate positioning of the sheet material relative to the printhead precisely as intended by the printing program. Accordingly, the printed image is not distorted or displaced.

The invention has particular utility in printing apparatus in which multiple passes of the sheet material relative to the printhead are used to create multi-color images. Generally each color image requires a separate pass of the sheet material under the printhead, and the sheet material must be returned to the origin point at the beginning of each pass. In one embodiment of the present invention, the backlash elimination means includes backspacing means to insure that the sheet material and printhead can be moved relative to one another by an incremental amount at the beginning of the printing operation to bring the printhead to the origin point of the image and thereby start to print the image precisely at the origin point as intended by the printing program.

DESCRIPTION OF THE PREFERRED EMBODIMENTS

Figure 1:
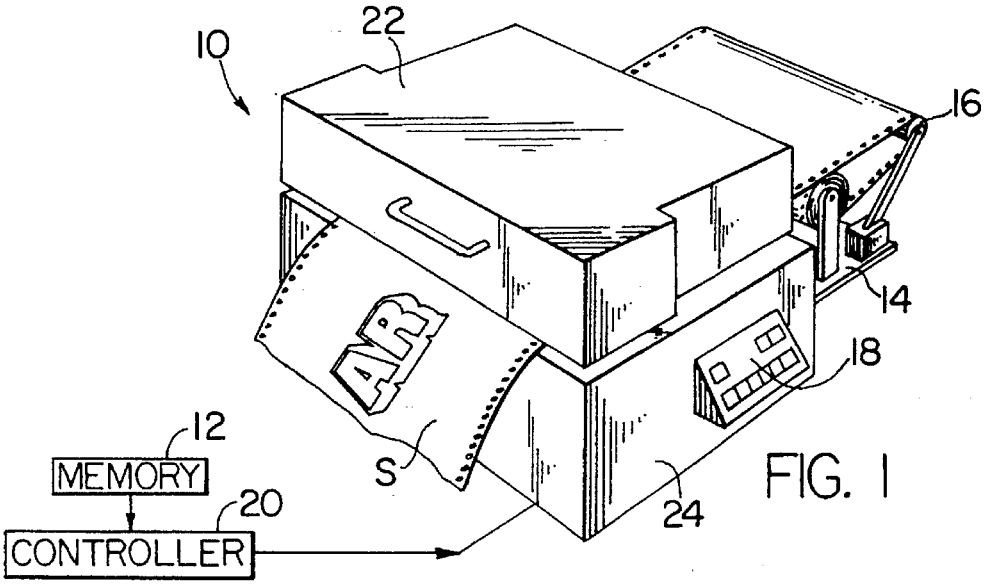
FIG. 1 is a perspective view illustrating a printing apparatus constructed in accordance with the present invention.

FIG. 1 illustrates a printing apparatus, generally designated at 10, which embodies the present invention and responds to a printing program stored in a memory 12 to generate printed images on a strip S of sheet material. The strip is supplied in a roll which is supported on a platform 14 on the backside of the machine and is pulled over a guide roller 16 into the machine. The strip exits at the front side of the machine with the printed images. For example, the printer 10 in one embodiment is a thermal printer, and the strip S of sheet material is a vinyl strip secured to a releasable backing material by a pressure sensitive adhesive. After an image such as the letters "AR" is printed on the material, the material can be placed in a cutting machine where the letters are cutout, lifted from the backing material and then placed on a sign board or other object. The entire printing and cutting system is described more particularly in copending U.S. patent application Ser. No. 08/007,662, filed Jan. 22, 1993.

The information printed on the strip S of sheet material is held in digital form in the memory 12 and when the operator of the printer calls for a printing program to be carried out through the control panel 18, a microprocessor-based controller 20 downloads the program from memory and generates machine commands that are fed to the printhead and drive mechanism for moving the strip S of sheet material through the printer.

The printer includes a cover 22 which is pivotally mounted to the base or frame 24 in order to open the printer and initially load the strip S of sheet material in the printer.

Figure 4:
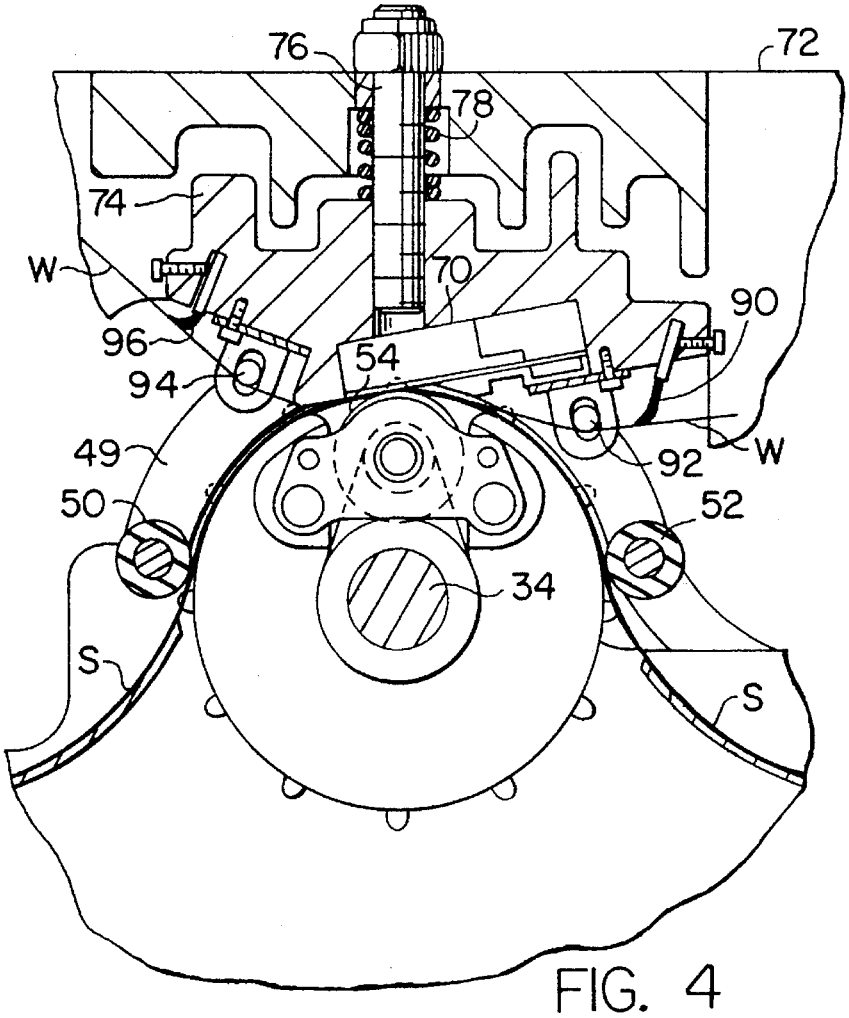
FIG. 4 is an enlarged sectional view of the printing apparatus showing the printhead and the roller platen for the sheet material.
Figure 2:
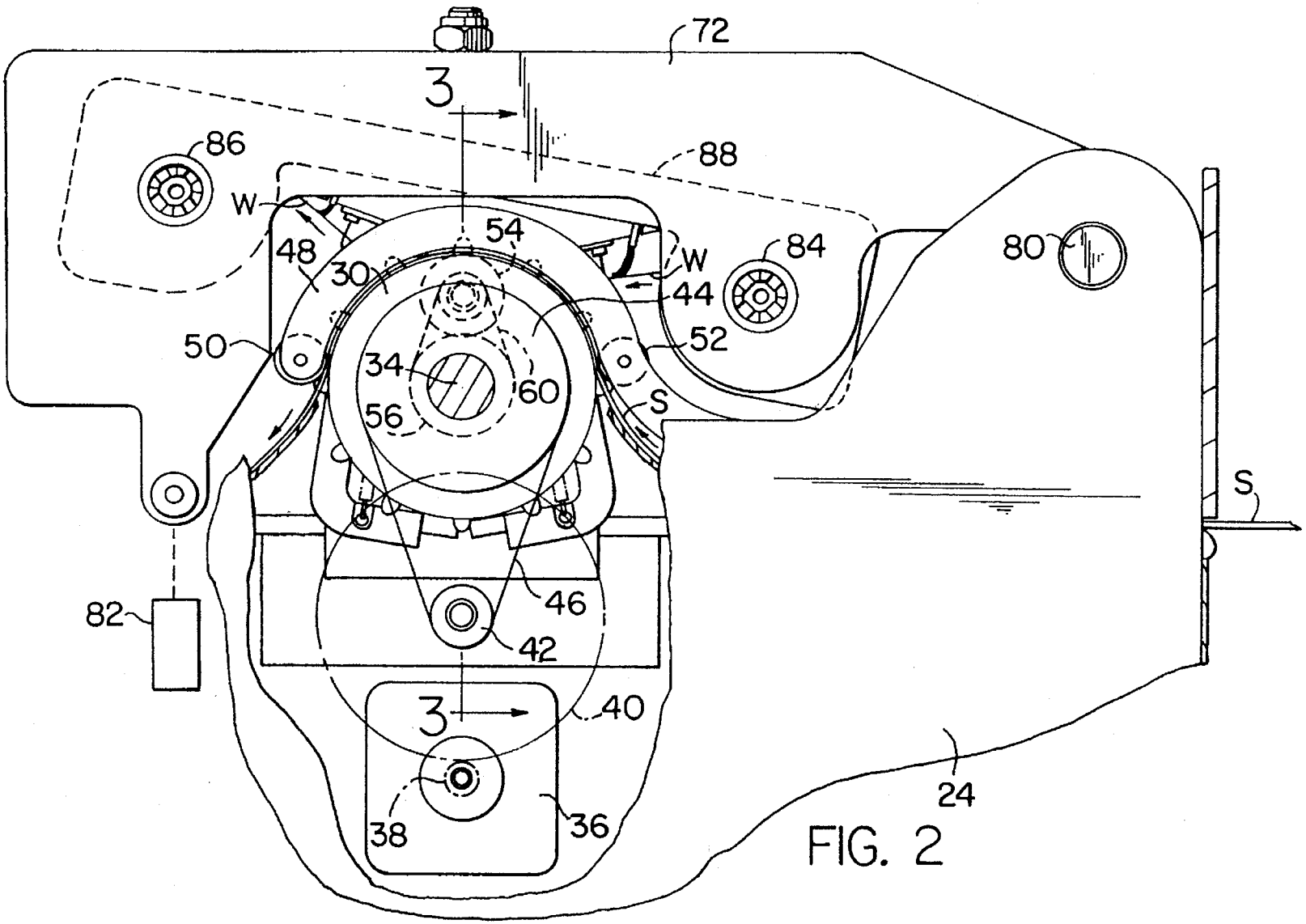
FIG. 2 is a fragmentary view of the printing apparatus in FIG. 1 and shows the drive mechanism for a strip of sheet material on which the apparatus prints.
Figure 3:
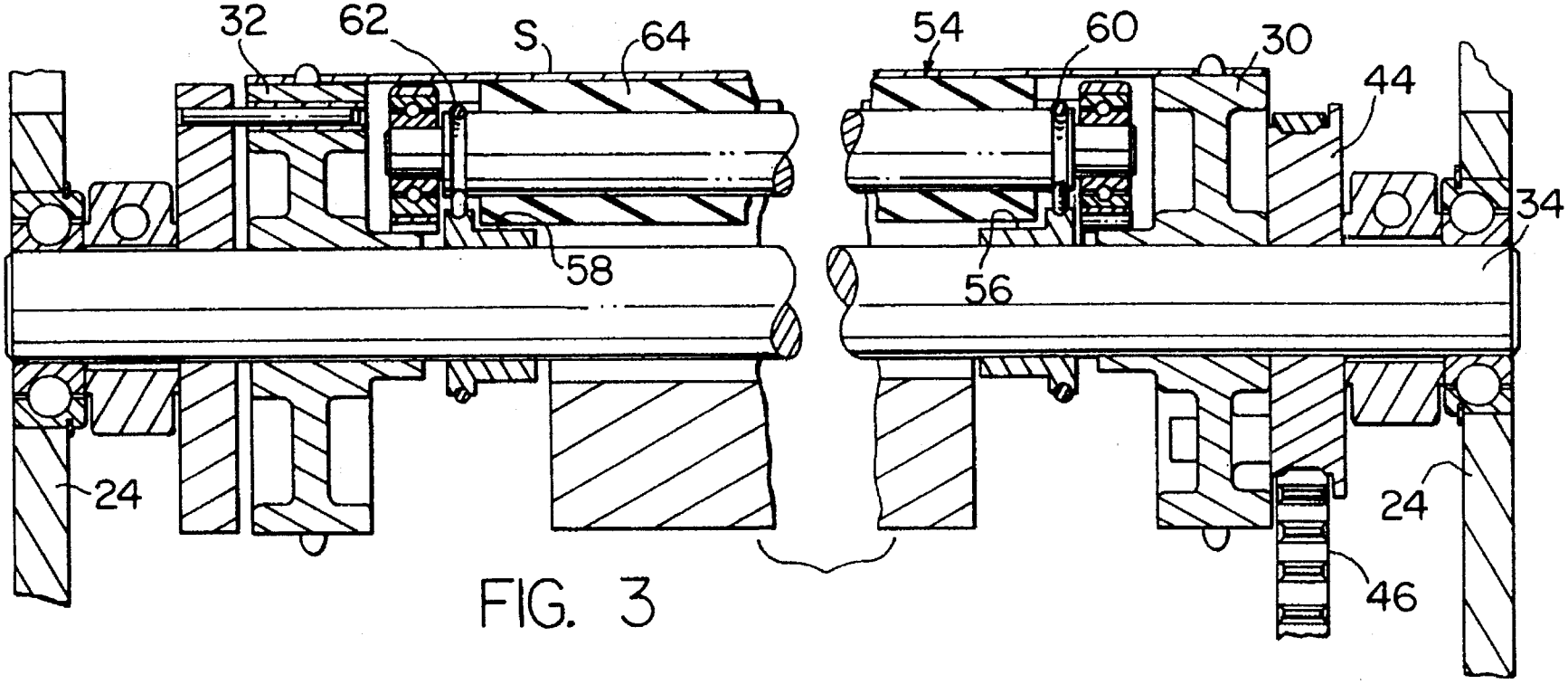
FIG. 3 is a fragmentary sectional view of the printer showing the drive mechanism as viewed along the sectioning lines 3—3 of FIG. 2.

FIGS. 2–4 illustrate the interior of the printer 10 in detail with the cover 22 removed. The drive mechanism for moving the strip S of sheet material through the printer during printing as indicated by the arrows in FIG. 2 includes a pair of drive sprockets 30, 32 which are secured to a drive shaft 34 rotatably mounted within the base 24. A drive motor 36 mounted within the base in FIG. 2 is rotatably connected to the drive shaft 34 through a series of drive gears 38,40, toothed drive pulleys 42, 44 and a toothed drive belt 46. The sprockets 30, 32 engage a series of feed holes extending longitudinally along the lateral edges of the elongated strip of sheet material as shown in FIG. 1.

In order to keep the strip engaged with the sprockets, a pair of liftable bail arms 48 in FIG. 2 and 49 in FIG. 4 rest on the sprockets at each end of the drive shaft 34 and support holddown rollers 50, 52 to keep the strip engaged with approximately 180° of the sprocket circumferences.

In addition, a roller platen 54 extends between the sprockets 30, 32 tangent to the cylindrical plane of the sprockets at their uppermost point and supports the strip S of sheet material between the sprockets. In one embodiment of the invention, the strip of sheet material is 15 inches wide and the roller platen is approximately 12 inches wide so that the longitudinal edge portions of the strip overlap the platen 54 and the feed holes engage the sprockets. The platen can, if desired, be rotatably driven by pulleys 56, 58 secured to the drive shaft 34 and elastomeric drive belts 60, 62 that extend between the pulleys and grooves at the end of the roller platen. The platen is preferably formed with a hard rubber sleeve 64 that defines a friction drive surface engaging the strip of sheet material and supporting the material directly under a printhead 70 as shown most clearly in FIG. 4.

As shown in FIGS. 2 and 4, the printhead 70 is resiliently supported in a support frame 72 by a suspension plate 74 and a series of slidable bolts 76 and springs 78. The printhead 70 extends transversely across the strip S of sheet material and has a width approximately equal to the width of the roller platen. The printhead 70 is a thermal printhead having a plurality of heating elements distributed evenly along the head from one end to the other, and the heating elements are densely packed, for example at a density of 300 elements per inch, along a line or zone of contact with the strip S on the roller platen. One such head is manufactured by Kyocera Industrial Ceramics, Inc. of Kyoto, Japan.

To control the printing pressure applied by the head 70 during a printing operation, the bolts 76 and springs 78 are distributed at various locations between the mounting plate 74 and the support frame 72 and the bolts slide freely relative to the support frame 72 while the springs 78 apply pressure forces evenly to the suspension plate 74 and printhead 70 along its length. Although the bolts and springs are shown mounted coaxially in FIG. 4, it is equally feasible to position the bolts and springs separately.

To raise and lower the printhead and to regulate the printing pressure, one end of the support frame 72 is pivotally mounted to the base 24 on a shaft 80 as shown in FIG. 2, and the other end of the frame is moved up and down by a pressure actuator 82 in response to commands from the controller 20 in FIG. 1. By this means the springs 78 transmit regulated pressure to the printhead 70 and the strip S of the sheet material on the roller platen 54.

In order to print images on the strip S with the thermal printhead 70, a donor web W bearing a thermally releasable printing ink is fed between the printhead 70 and the strip S as shown in FIGS. 2 and 4. The web W extends between two spools 84, 86 of a replaceable cassette 88 mounted in the support frame 72. The web extends from the supply spool 84 past a static reduction brush 90 shown in FIG. 4, and then under a dancer rod 92 to the printhead. When the printhead is lowered into a printing position, the web W is sandwiched between the printhead and the strip S of sheet material along the line or zone of contact established by the curvature of the platen 54. The web extends further from the head over another dancer rod 94 past another static brush 96 to the take-up spool 86 shown in FIG. 2.

During a printing operation, the drive sprockets 30, 32 and the roller platen 54, if driven, pull the strip S of the sheet material over the roller platen relative to the printhead 54 in the direction of the arrows in FIG. 2 while the heating elements of the printhead are selectively excited in order to release the printing ink from the web W onto the sheet material. Friction between the web W and the strip S under pressure applied by the printhead causes the web W to advance synchronously with the sheet material so that a fresh segment of the web W is always present under the head.

The thermally releasable printing ink that is released from the web W during a printing operation may be red, yellow or any other color, and prints an image of a corresponding color on the sheet material. If the image is a multi-color image, the web W must contain segments of different colors, or alternatively, the cassette 88 must be exchanged for other cassettes containing webs W bearing different color inks. During the indexing of a web or exchange of a cassette, the strip of sheet material is drawn back in the direction opposite the arrows in FIG. 2 to the beginning of the printed image which corresponds to an origin point in the image and the stored printing program. With another cassette or web segment installed the printing operation is continued in a second color by again advancing the web in the forward direction indicated by the arrows relative to the roller platen.

OPERATION

Figure 5:
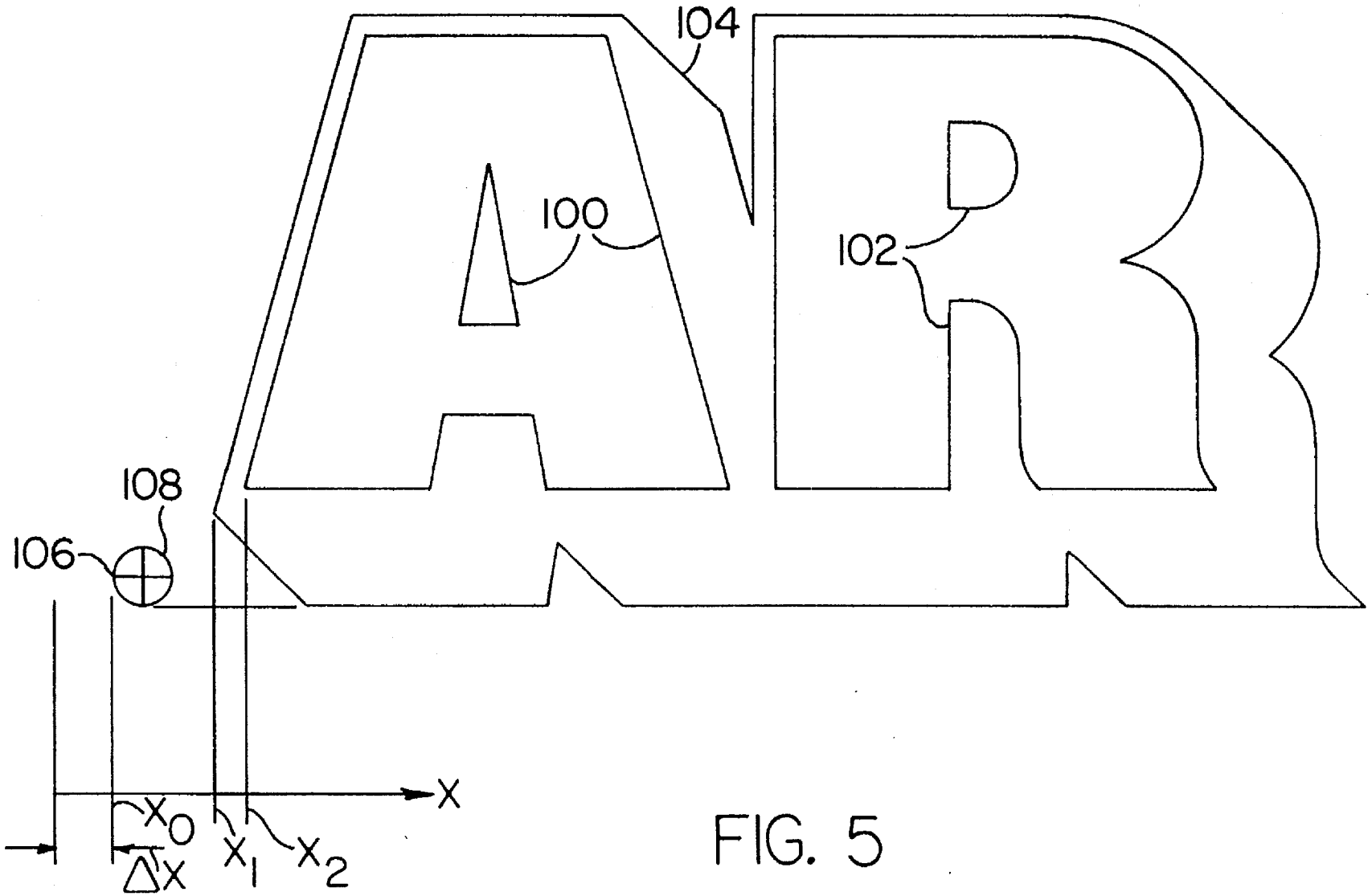
FIG. 5 is a printed two dimensional image of the letters AR with three-dimensional features and shows the dimensional parameters that are employed by the present invention.

FIG. 5 is provided in order to explain more clearly the process of printing a multi-colored image with the printer 10. It is assumed that the two dimensional image of the letters "AR" with three dimensional features would be printed with the front face of the letters in one color, such as red, and the "third dimension" of the letters in another color, such as black. The profiles 100, 102, 104, of each color are separately defined in the printing program stored in the memory 12, each profile being referenced to a common origin point $X_O$ such as the left-most point 106 of the bullseye 108. The bullseye, for example, may be used subsequently in a numerically controlled cutting machine in order register the image of the letters "AR" with respect to the machine as described more particularly in the above-referenced application Ser. No. 08/007,662.

It should be understood that in FIG. 5 the coordinate X represents the motion of the head relative to the vinyl sheet material S, and the coordinates $X_0$, $X_1$, $X_2$represent different positions on the vinyl sheet material as measured in the X coordinate direction. For example, the coordinate $X_0$ represents the coordinate of the origin point 106. The coordinate $X_1$ represents the limit or first print point for the black portion of the image, and the coordinate $X_2$ represents the limit or first print point for the red portion of the image. During a printing operation the bullseye 108 would be printed first in one of the two colors by the printhead and then the other portion of the image in the same color, that is for example the portion beginning at $X_1$, would be printed progressively from left to right as viewed in FIG. 5 as the strip S of vinyl sheet material moves relative to the printhead.

Thereafter, the vinyl sheet material S is moved back under the printing head in the –X direction until the origin point 106 is located under the printhead. Then the material is backspaced or moved further in the –X direction by the incremental amount ΔX. At this point the printer 10 would be opened by the operator by lifting the cover 22 and pivoted support frame 72, the cassette 88 containing a web W of ink material would be removed and replaced with a cassette of the second color and the printer would be closed and again energized to continue the printing operation. The printer then advances by an amount ΔX to eliminate all backlash in the drive mechanism for the vinyl sheet material which places the origin point 106 precisely under the printhead as it was at the start of printing of the first color. The printer proceeds from the origin point by moving to the coordinate of the second color, for example $X_2$, and continues the printing operation progressively from left to right as shown in FIG. 5. Naturally, the incremental motions ΔX in the forward or rearward direction from and to the origin point 106 respectively may be continuous or discontinuous with the preceding or subsequent motions of the strip.

At the end of the printing operation, the strip of sheet material could be automatically or manually advanced in order to totally remove the image from the printer. The portion of the strip bearing the finished image is then removed from the rest of the strip.

Figure 6:
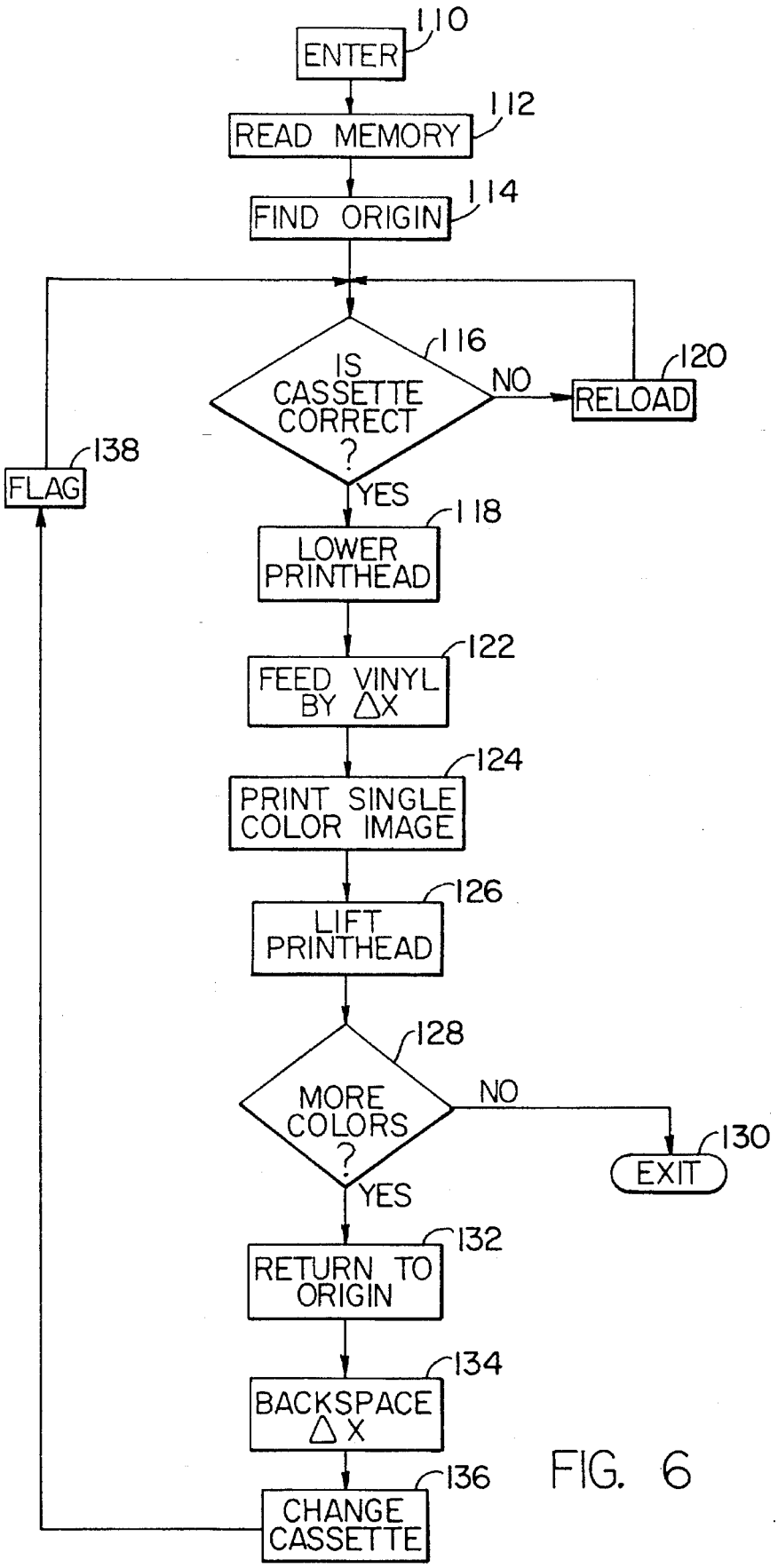
FIG. 6 is flow chart detailing the operation of the printer controller including the backlash eliminator.

The flow chart of FIG. 6 illustrates the basic steps of an operating program utilized by the controller 20 to carry out printing operations such as the printing of the letters "AR" as described in connection with FIG. 5.

It is assumed at the outset that a strip of vinyl on a backing material is loaded into the printer 10 so as to be fully engaged with 180 degrees of the drive sprockets 30, 32. A strip sensor of a type described in greater detailed in the above-referenced application Ser. No. 08/007,662 is used to confirm this condition to the printer operator through the control panel 18. The operator then starts the print program through the panel, and the subroutine for printing is entered at block 110 in FIG. 6. The program defining the letters "AR" which is stored in the memory 12 is read and downloaded into the controller 20 of FIG. 1 as indicated at instruction 112 and the controller locates the origin point 106 in the program data as indicated at instruction 114.

At branch 116, the controller determines whether the correct cassette containing the web W with a colored printing ink has been loaded into the machine. For example, if the first color to be printed is the black, third dimension of the letters "AR" and the cassette bears a coding that is read by the printer and identified as a cassette having a donor web bearing black ink, the program then advances directly from branch 116 to instruction 118. If the wrong cassette had been loaded in the machine, the program would branch to the reload instruction 120 and a warning signal on the control panel 18 would advise the operator that the wrong cassette had been loaded. After the correct cassette was loaded, the program would proceed again through branch 116 to instruction 118.

The printhead having initially been in an elevated position is lowered into contact with the web W and strip S of sheet material overlying the roller platen 54. With the printhead lowered and prepared to actually begin printing, the program causes the drive mechanism including the drive motor 36 and the sprockets 30, 32 to move the strip of vinyl and releasable backing material by the incremental amount ΔX in the positive direction as indicated at instruction 122. The incremental amount of movement, which may for example be 0.150 inch, causes the vinyl to be moved to precisely locate the origin point under the printing head, and at the same time eliminates all of the backlash through the gears 38, 40, pulleys and drive belt 42, 44, 46 and between the sprockets 30, 32 and the feed holes in the strip S of vinyl material. Thus,-the next drive pulse which feeds the strip of vinyl precisely advances the strip relative to the printhead as intended by the printing program, and the printed image thus corresponds precisely with the data in the printing program. If backlash had not been eliminated, then distortion of the image could occur in the initial portion of the image. For example, FIG. 5 shows the initial increment of movement ΔX in the X coordinate direction which brings the strip of vinyl to the origin point 106 at the left-hand limit of the bullseye 108. Printing can then begin with assurance that the bullseye will not be distorted and the bullseye can therefore be relied upon as an accurate reference for all other data points in the printed image.

Once the vinyl has been moved incrementally by the amount ΔX as shown at instruction 122, the printing program continues by printing a single color image defined by the printing program as indicated by instruction 124. At the end of the single color image, the printhead is lifted as indicated at instruction 126 and the controller determines if there are additional colors to be printed at branch 128. If not, the program is exited at 130. However, in the scenario described here, it will be assumed that a second color is to be printed in the image in conjunction with the previously printed color and, therefore, the drive mechanism reverses the motion of the strip S of sheet material and returns the strip to the origin point 106 as indicated by instruction 132. When the strip has returned to the origin point, the drive mechanism continues the backward movement of the strip or backspaces the strip by the amount ΔX as indicated at instruction 134 to bring the strip generally into the same position that it occupied at the beginning of the printing operation.

At this point in the printing operation, backlash in the drive mechanism including any backlash between the sprocket teeth and the feed holes of the vinyl strip may result in slight positioning errors between the strip and the head.

The program then advances to instruction 136 which visually signals the printer operator that the cassette needs to be changed to print another color. The program then advances to the interrupt flag 138 and stops in order to allow the operator to open the machine, change the cassette and close the machine again. After the cassette is changed, the operator again starts the printer through the control panel 18 (FIG. 1), and the program advances to the branch 116. Again the program determines whether the correct cassette has been loaded and if not a reload command is given at instruction 120. With the correct cassette in the machine, the program advances to instruction 118 to cause the printhead to be lowered into engagement with the strip of vinyl. The vinyl is then fed by the incremental amount $\Delta X$ by the instruction 122 which eliminates any positional errors that arise due to the backlash in the drive system. Accordingly, by the time the program has advanced to the instruction 124 to print the second color of the image, backlash has been removed from the drive mechanism and the strip and printhead are in proper registration with one another at the origin point 106. Printing then continues as described above for the first color without distortion of the image and with assurance that both colored portions of the image will be in proper registration with one another throughout the image.

While the present invention has been described in a preferred embodiment, it should be understood that numerous modifications and substitutions can be made without departing from the spirit of the invention. Basic to the invention is the movement of the sheet material and printhead relative to one another by an incremental amount at the beginning of each portion of the printing operation so that the strip and printhead are always in correct positional relationship with one another at the origin point. Preferably, but not necessarily, the printhead is raised out of contact with the vinyl sheet material during the period in which it is backed up to return to the origin point. The drive mechanism utilized to engage the strip of sheet material may include motors, gears, pulleys, drive belts, sprockets and other types of mechanical or electrical devices all of which are likely to introduce certain amounts of backlash or hysteresis. Although the invention has been described in conjunction with a thermal printer that utilizes a web of inking material, it may be used with other types of printers with equal success. The origin point to which the printhead and material are incrementally moved to eliminate backlash is the point where the printing program as stored in memory begins the printing operation. That point may be part of the primary image, an auxiliary portion of the image as in the case of the bullseye 108 or may not be a visible portion of the image at all.

Accordingly, the present invention has been described in several embodiments by way of illustration rather than limitation.

I claim:

1. A printing apparatus for printing in multiple colors on sheet material comprising:

a printhead responsive to a printing program defining a printing operation for placing a printed image on a sheet material;

a donor web bearing a printing ink of one selected color, the web being replaceable to permit printing in other colors;

means for supporting the donor web bearing printing ink between the printhead and the sheet material to enable the printhead to transfer the ink selectively from the web to the sheet material;

drive means coupled with the printhead and the sheet material for moving the printhead and the sheet material relative to one another in a printing direction during a printing operation to place the printed image on the sheet material; and controller means connected with the printhead and the drive means and responsive to the printing program for controlling the operation of the printhead and the drive means to print a multiple color image long the sheet material relative to an origin point defined in the printing program and located at the beginning of the image in the printing direction, the controller means also including backlash elimination means actuating the drive means and displacing the printhead and sheet material relative to one another in the printing direction by an incremental amount to the origin point with each replacement of a donor web.

2. A printing apparatus for printing on an elongated sheet material as defined in claim 1 wherein:

the drive means is coupled with the elongated strip of sheet material and moves the strip longitudinally of itself relative to the printhead in the printing direction; and the backlash elimination means actuates the drive means to advance the strip of sheet material in the printing direction by an incremental amount relative to the printhead prior to the beginning of a printing operation at the origin point.

3. A printing apparatus for printing as defined in claim 2 wherein the drive means includes motor-driven sprockets which engage a series of feed holes extending longitudinally along the lateral edges of the elongated strip of sheet material.

4. A printing apparatus as defined in claim 1 for printing on an elongated strip of sheet material wherein:

the donor web is an elongated web bearing printing ink; and the drive means engages the elongated strip of sheet material and advances both the strip and the donor web relative to the printhead during printing.

5. A printing apparatus for printing in multiple colors on a strip of sheet material comprising:

a printhead;

a donor web bearing a printing ink of at least one selected color, the web being replaceable to permit printing in different colors;

means for supporting the donor web bearing the printing ink between the printhead and the strip of sheet material to enable the printhead to transfer ink selectively from the web to the sheet material;

drive means for engaging a strip of sheet material and moving the strip longitudinally in a printing direction relative to the printhead; and controller means coupled to the printhead and the drive means and responsive to a printing program for controlling both the printhead and the drive means to print a multiple color image longitudinally along the strip of sheet material in the printing direction relative to origin point defined in the printing program and located at the beginning of the image, the controller means including backlash elimination means causing the drive means to reverse the movement of the sheet material and move the origin point back to the printhead and then to advance the strip of sheet material at least incrementally relative to the printhead in the printing direction prior to the start of printing on the material after each replacement of a donor web.

6. A printing apparatus for printing as defined in claim 6 wherein:

the drive means engages and moves the strip of sheet material back and forth relative to the printhead;

the controller means controls the back and forth movement of the strip to cause the strip to make multiple passes by the printhead in response to the printing program; and the backlash elimination means causes the drive means to reverse the movement of the sheet material and move the origin point back to the printhead and then to advance the strip of sheet material incrementally relative to the printhead in the printing direction prior to the beginning of each pass by the printhead.

7. A printing apparatus for printing as defined in claim 6 wherein:

the backlash elimination means includes backspacing means for returning the strip of sheet material after a pass by the printhead to a position in advance of the origin point for the printed information.

8. A printing apparatus for printing as defined in claim 7 wherein:

the printhead is moveable into and out of contact with the strip of sheet material; and the controller means causes the printhead to move into contact with the strip of sheet material before the material is incrementally advanced prior to the start of printing, and causes the printhead to move out of contact with the strip of sheet material prior to returning the strip of sheet material.

9. A printing apparatus for printing as defined in claim 5 wherein:

the printhead is moveable into and out of contact with the strip of sheet material during a printing operation in response to the controller means; and the controller means causes the printhead to move into contact with the strip of sheet material prior to the advance of the strip at least incrementally.

10. A printing apparatus as defined in claim 5 wherein the print head is a thermal printhead extending transversely of the strip of sheet material; and a doner web bearing a thermally transferable ink material is pressed between the printhead and the strip of sheet material during printing.

11. A method of printing multiple color images defined in a printing program on sheet material in a machine controlled by the program and having a printhead, a donor web bearing a printing ink of at least one selected color, the donor web being replaceable to permit printing in different colors, the donor web and the sheet material being supported to enable the printhead to transfer the ink selectively from the web to the sheet material, and drive means for moving the printhead and sheet material relative to one another in one direction during a printing operation comprising the steps of:

selectively energizing the printhead and the drive means in response to the printing program to move the printhead and sheet material relative to one another in the one direction and transfer ink from one donor web bearing ink of one selected color to the sheet material to print one color component of an image on the sheet material relative to an origin point defined in the printing program;

energizing the drive means to move the printhead and sheet material relative to one another in the direction opposite to the one direction by an amount greater than the length of the image in the one direction;

replacing the one donor web bearing ink of one selected color with another donor web bearing ink of another selected color;

energizing the drive means upon replacement of the one donor web to move the printhead and sheet material relative to one another by at least an incremental amount in the one direction to remove backlash in the drive means and then selectively energizing the printhead and the drive means in response to the printing program to move the printhead and sheet material relative to one another in the one direction and transfer ink from the other donor web bearing ink of the another selected color to the sheet material to print another color component of the image on the sheet material.

12. A method of printing images on sheet material as defined in claim 11 wherein: the sheet material is an elongated strip of sheet material; and the step of energizing the drive means upon replacement of the one donor web includes energizing the drive means to move the strip longitudinally of itself by an incremental amount in the one direction relative to the printhead.

13. A method of printing images on sheet material as defined in claim 12 wherein further steps include:

after moving the strip at least an incremental amount, continuing the movement of the strip of sheet material in the one direction relative to the printhead while generating images with the printhead on the sheet material in accordance with the printing program; and then moving the strip of sheet material longitudinally of itself in the direction opposite to the one direction without generating images on the sheet material until the previously generated images have completely passed by the printhead; and then again energizing the drive means to move the strip of sheet material longitudinally of itself by an incremental amount in the one direction to remove backlash before reenergizing the printhead.

14. A method of printing as defined in claim 13 wherein the step of moving the strip in the direction opposite the one direction allows the subsequent energizing and movement of the strip by at least an incremental amount in the one direction to place the printhead in the same position with respect to the strip as when the printhead was originally energized to print images.

15. A method of printing images as defined in claims 13 wherein the printhead is a thermal printhead and further steps include:

placing the thermal printhead in contact with the strip of sheet material during the movement of the strip in the one direction; and holding the thermal printhead out of contact with the strip of sheet material during the movement of the strip in the direction opposite to the one direction.

16. A method of printing images on sheet material as defined in claim 12 wherein the printhead is a thermal printhead extending transversely of the elongated strip of sheet material.

17. A method of printing images as defined in claim 13 wherein the printhead is a thermal printhead and further steps include interposing between the printhead and the strip of sheet material donor webs bearing thermally transferable ink materials for generating the images in different colors.

* * * * *

UNITED STATES PATENT AND TRADEMARK OFFICE

CERTIFICATE OF CORRECTION

PATENT NO. : 5,513,919

DATED : May 7, 1996

INVENTOR(S) : Charles M. Hevenor

It is certified that error appears in the above-identified patent and that said Letters Patent is hereby corrected as shown below:

In Column 9, Line 1:

Delete "6" and substitute "5".

Signed and Sealed this

Tenth Day of February, 1998

*Attest:*

Bruce Lehman

BRUCE LEHMAN

*Attesting Officer*

*Commissioner of Patents and Trademarks*